US005515769A

United States Patent [19]

Basinski et al.

[11] Patent Number: 5,515,769

[45] Date of Patent: May 14, 1996

[54] AIR COMPRESSOR

[75] Inventors: Edward M. Basinski, Manlius; Richard L. Martin, Cicero, both of N.Y.; M. Wayne Meece; John H. Bolthouse, II, both of Monore, La.

[73] Assignees: Carrier Corporation; Thomas Industries Incorporated, both of Syracuse, N.Y.

[21] Appl. No.: 267,419

[22] Filed: Jun. 28, 1994

[51] Int. Cl.[6] ..... F15B 21/04

[52] U.S. Cl. ..... 92/80; 92/82; 92/169.1; 417/420

[58] Field of Search ..... 92/80, 82, 169.1, 92/171.1; 417/420; 123/572

[56] References Cited

U.S. PATENT DOCUMENTS

| | | | |
|---|---|---|---|
| 1,479,603 | 1/1924 | Hiller | 92/82 |
| 2,178,662 | 11/1939 | Hanson | 92/82 |
| 2,256,926 | 9/1941 | Maniscalco | 92/82 |
| 2,375,718 | 5/1945 | Winkels et al. | 92/82 |
| 3,229,591 | 1/1966 | Cadiou | 92/82 |
| 3,808,659 | 5/1974 | Alger, Jr. et al. | 92/169.1 |
| 3,877,844 | 4/1975 | Klaus et al. | 417/420 |
| 3,961,868 | 6/1976 | Droege, Sr. et al. . | |
| 3,961,869 | 6/1976 | Droege, Sr. et al. . | |
| 4,275,999 | 6/1981 | Hetzel et al. . | |
| 4,730,550 | 3/1988 | Bramstedt et al. . | |
| 4,995,795 | 2/1991 | Hetzel et al. . | |
| 5,006,047 | 4/1991 | O'Connell . | |
| 5,022,312 | 6/1991 | Rozek et al. . | |
| 5,092,224 | 3/1992 | Rozek . | |
| 5,213,025 | 5/1993 | Rozek . | |
| 5,213,125 | 5/1993 | Leu . | |
| 5,244,363 | 9/1993 | Olson . | |

*Primary Examiner*—Thomas E. Denion

[57] ABSTRACT

An oilless reciprocating compressor for use in a refrigerated controlled atmosphere has an uncooled, fully sealed crankcase. A bypass tubing connects the interior of the crankcase with the inlet of the cylinders, so that blow-by is returned from the crankcase to the inlet of the cylinder for recirculation. In consequence no blow-by gas escapes into the controlled atmosphere. The device includes standard pistons, and has an improved cylinder head seal utilizing o-rings.

3 Claims, 5 Drawing Sheets

FIG.3

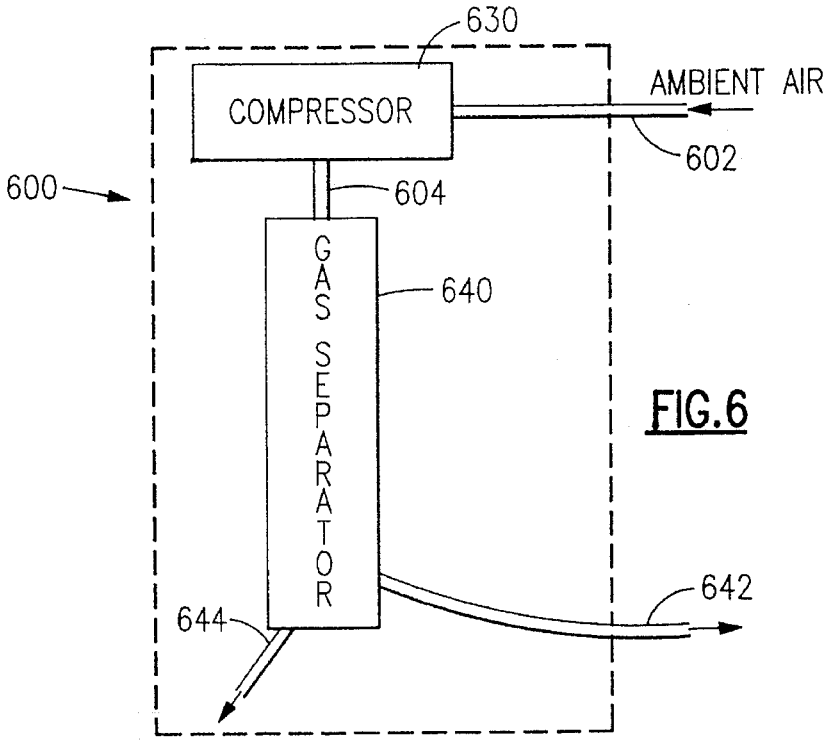
FIG.6
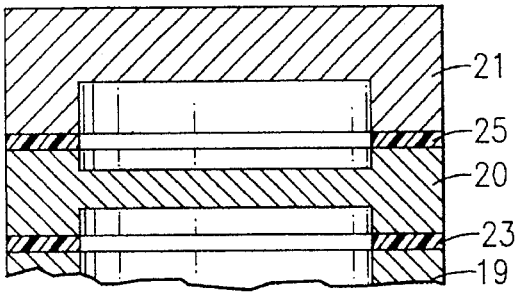
FIG.7
Prior Art
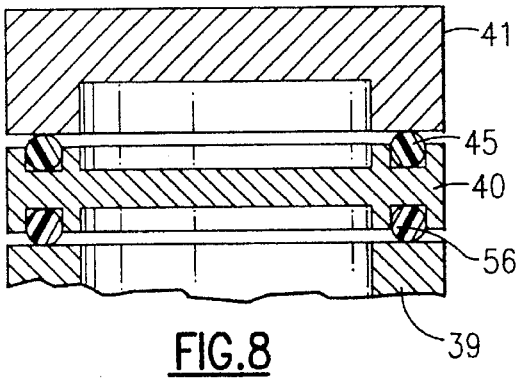
FIG.8
FIG.9
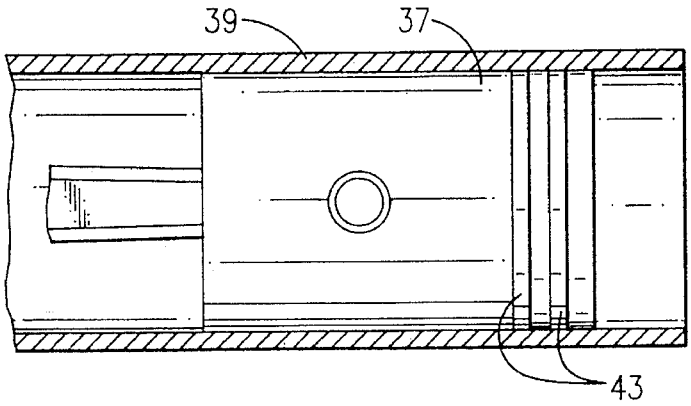

AIR COMPRESSOR

BACKGROUND OF THE INVENTION

1. Field of the Invention

This invention relates to fluid compressors. More particularly this invention relates to an oil free air compressor that is disposed in a controlled atmosphere, wherein the quantity of air leaking therefrom into the controlled atmosphere is minimized.

2. Description of the Prior Art

In cargo containers used for transporting food and other perishables it is necessary to maintain an oxygen poor atmosphere in order to prevent food spoilage, and to prevent damage from insects and similar vermin. Limiting the amount of oxygen in the container, while maintaining the internal temperature within a desired cool range inhibits metabolic processes within the food, and can eventually kill organisms that would attack valuable food cargo. In such containers the need to maximize payload volume limits the space that is available for refrigeration and environmental control equipment, including the system for maintaining the controlled internal atmosphere. This system typically includes an air compressor, heater, and filter that feeds a gas separator that discharges oxygen poor effluent into the chamber, and returns the remainder into the ambient. The gas separator is typically a semipermeable membrane. In order to conserve space, and to protect the system from a harsh marine environment it is standard practice to dispose its air compressor inside the container, within the controlled atmosphere. The protection from salt water and particulates afforded by internal placement of the compressor, and the cool internal temperatures of the operating environment extend the useful life of the air compressor and other components of the system.

The air compressor typically takes in ambient air. Therefore any leakage therefrom will detrimentally affect the controlled atmosphere, and is to be avoided. In the reciprocating compressors in common use today, such leakage can occur from blow-by across the piston rings, and can also occur through a poorly sealed head gasket. Blow-by occurs during upstroke of the piston, and pressurized air escapes from the cylinder's working chamber across the piston rings into the crankcase. The crankcase of a conventional reciprocating compressor is ventilated for cooling, and the blow-by can thus escape into the immediate environment of the compressor. Conventional compressors may also include a fan assembly disposed on an extension of the motor shaft to further cool the unit. The fan increases the space required for placement of the unit.

In Olson, U.S. Pat. No. 5,244,363, it is proposed to limit blow-by in an oilless air compressor by providing a port in the cylinder such that the port is above a first piston ring when the cylinder is positioned at top dead center, and is below a second piston ring when the piston is positioned at bottom dead center. In this arrangement any gas that blows by the first ring exits the cylinder through the port, rather than blowing by the second ring into the crankcase. The fluid can then be exhausted or recycled through the compressor inlet. Other approaches to limiting blow-by involve increasing the number of piston rings. This is expensive and requiring machining special pistons. This approach also increases the complexity of the unit.

SUMMARY OF THE INVENTION

It is therefore a primary object of the present invention to provide an oilless air compressor having low blow-by for use in a controlled atmosphere.

It is another object of the present invention to provide an air compressor that is physically compact, and suitable for use in a cargo container.

It is yet another object of the present invention to provide an oilless reciprocating air compressor that utilizes readily available pistons and cylinders and can be economically produced.

These and other objects of the present invention are attained by an oilless fluid reciprocating compressor for use in a controlled atmosphere, having an uncooled, fluid-tight crankcase with an internal chamber, so that the interior of the crankcase is isolated from the atmosphere thereabout. The crankcase cover has a hole bored therethrough for admitting a bypass tubing that places its interior in fluid communication with the inlet of the cylinder. Fluid blowing by the piston during a compression stroke thereof is returned from the crankcase through the bypass to the inlet for recirculation. In consequence no blow-by gas escapes into the controlled atmosphere.

In accordance with one aspect of the invention, the piston includes no more than two piston rings.

In accordance with another aspect of the invention, a valve assembly located at the cylinder head is fitted with o-rings to provide a superior seal. A first o-ring is disposed between the cylinder head and the valve assembly; and a second o-ring is disposed between the valve assembly and the cylinder itself.

In accordance with yet another aspect of the invention, temperature resistant materials are used in the construction of the compressor. The valve assembly has a valve retainer fabricated of either stainless steel or a high temperature plastic. The cylinders are constructed of bronze, and the o-rings are made of high temperature plastic. The piston bearings are eccentrics fabricated of stainless steel.

In still another aspect of the invention, the compressor is manufactured without an external cooling fan, so that the crankcase is uncooled, except for cooling that may be provided from its refrigerated external environment.

BRIEF DESCRIPTION OF THE DRAWING

For a better understanding of these and other objects of the present invention, reference is made to the detailed description of the invention which is to be read in conjunction with the following drawings, wherein:

FIG. 6 is a diagram showing a part of the system shown in FIG. 5 with detail omitted;

FIG. 7 is a fragmentary view of a cylinder of a compressor in accordance with the prior art;

FIG. 8 is a fragmentary view of a cylinder of a compressor in accordance with the invention; and FIG. 9 is a sectional view of a cylinder of a compressor in accordance with the invention.

DESCRIPTION OF THE PREFERRED EMBODIMENT

Figure 1:
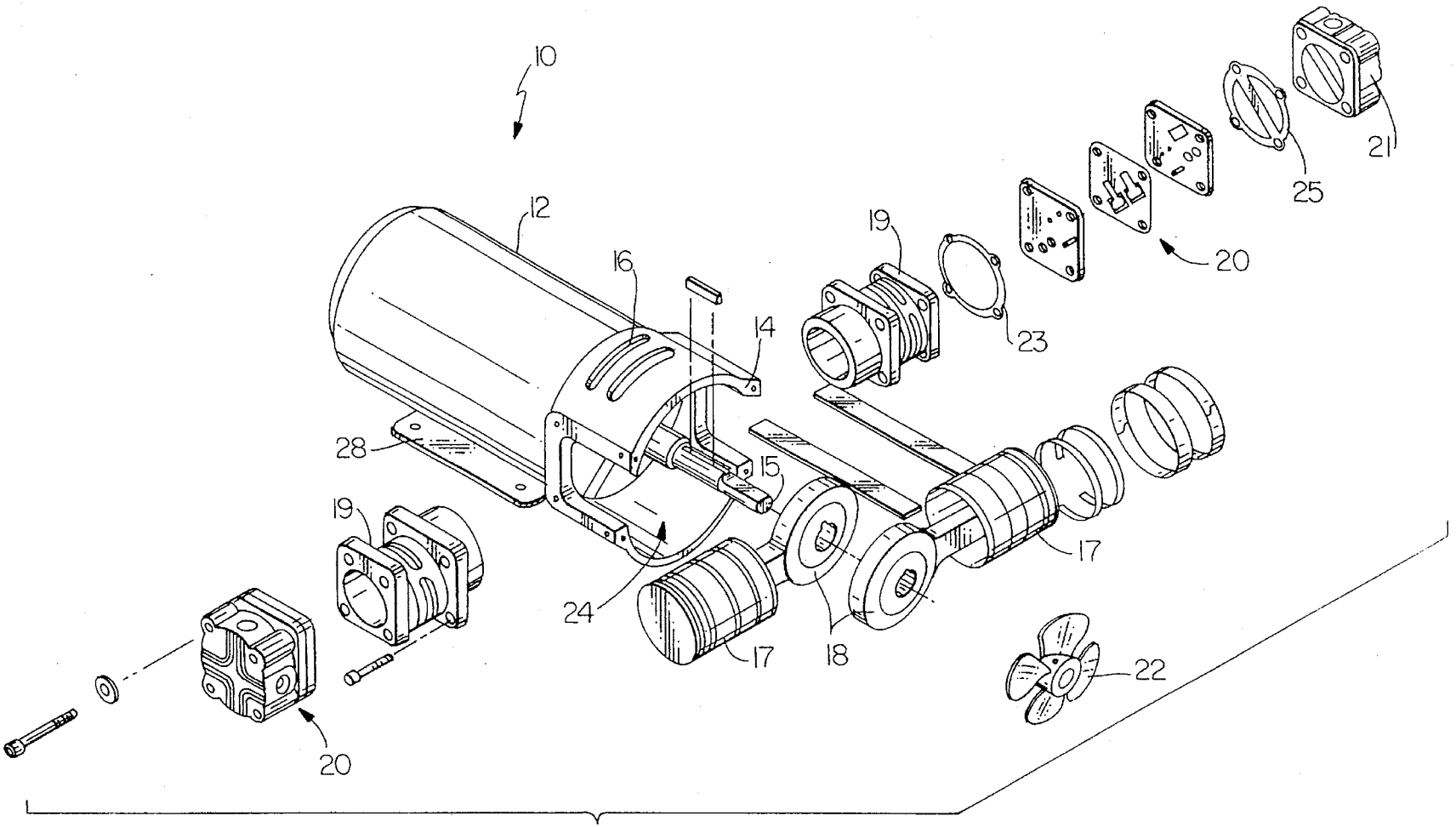
FIG. 1 Prior Art
FIG. 1 is an exploded view of an air compressor in accordance with the prior art.

It will be helpful in understanding the invention to first describe a conventional air compressor. In FIG. 1 there is shown an air compressor 10 powered by an electric motor 12. The motor rotates a motor shaft 15 inside a crankcase 14. Two pistons 17, 17 having eccentric bearings 18, 18 engage the motor shaft 15, and are reciprocated within opposed cast iron cylinders 19, 19. The eccentric bearings are typically constructed of forged steel. Reed valve assemblies 20, 20 control gas flow in and out of the working chambers of the cylinders 19, 19, and the cylinders are capped by cylinder heads 21, 21. Gaskets 23, 25 provide seals for the cylinder heads and the valve assemblies. The inner compartment 24 contains the motor shaft 15, which protrudes thereout. The motor shaft 15 has a fan 22 mounted thereon, the fan assembly generally being encased in a housing (not shown). Placing the fan 22 outboard of the crankcase 14 aids in cooling the unit, but increases the space required by the compressor. A base plate 28 is provided for mounting the compressor in its working position. Tubing (not shown) connects the inlet to a source of gas, such as ambient air, and conveys the compressor's discharge for further gas processing or to a desired location.

Figure 2:
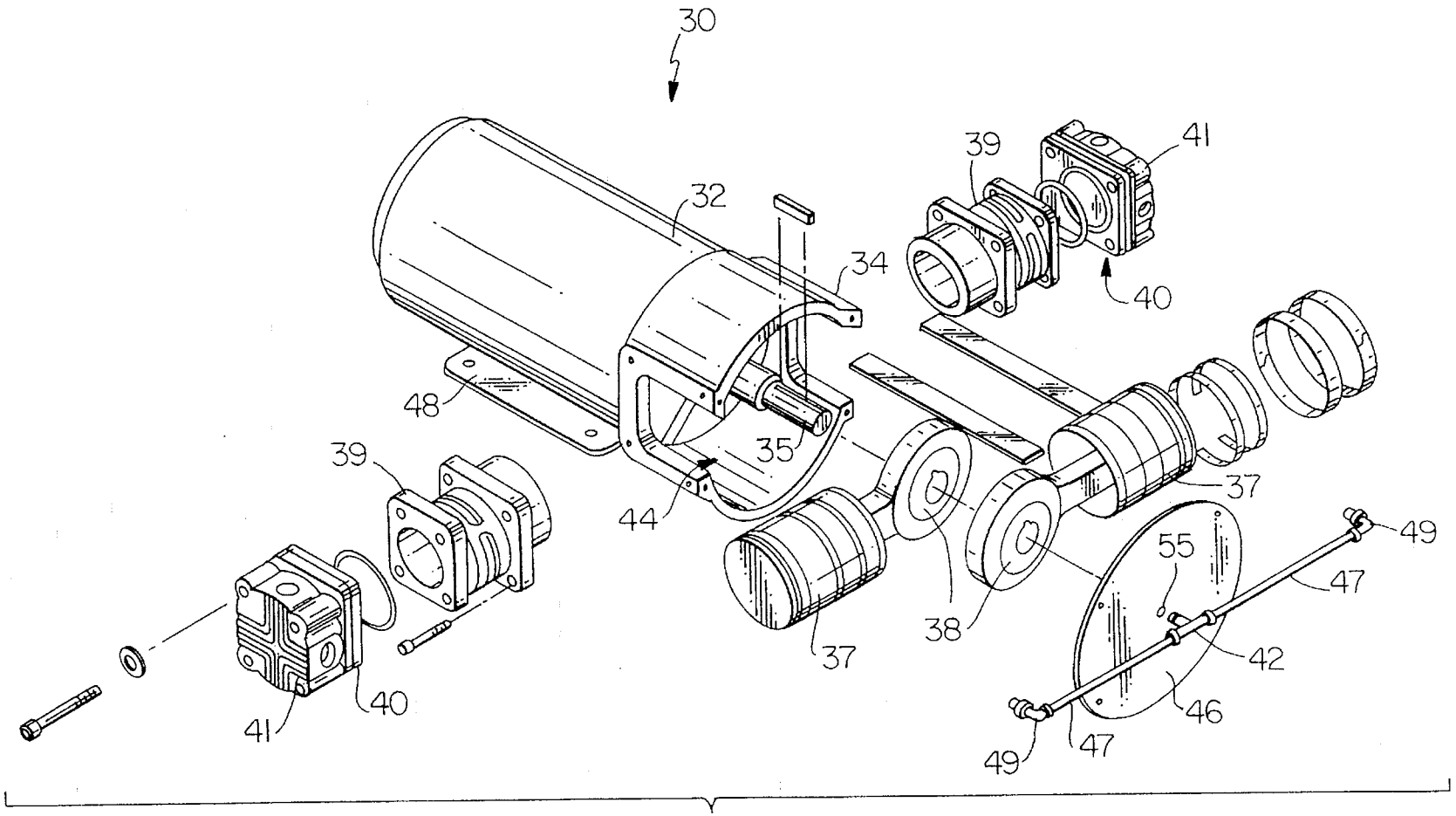
FIG. 2 is an exploded view of an air compressor in accordance with the invention.
Figure 4:
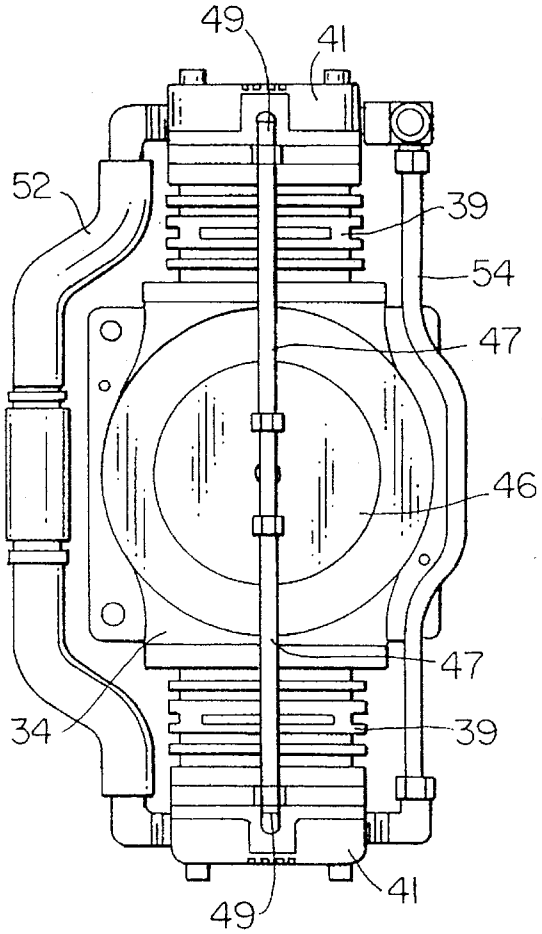
FIG. 4 is an end elevational view of the compressor shown in FIG. 3.
Figure 3:
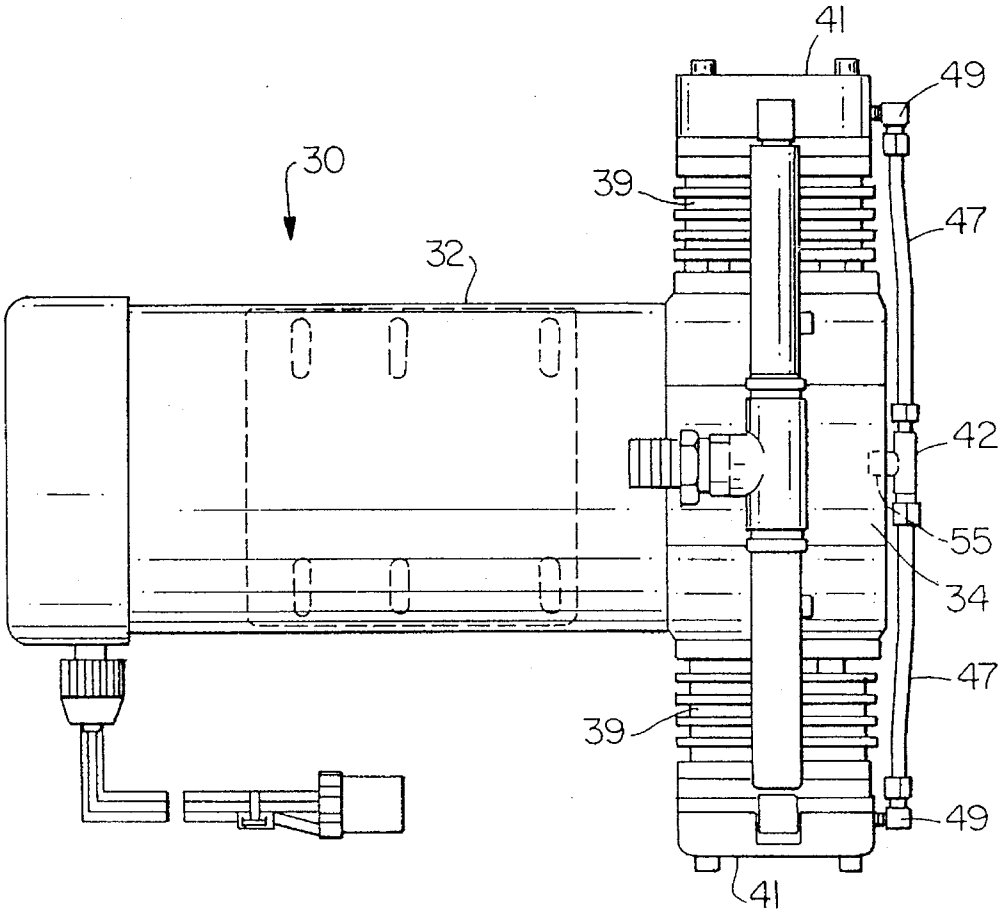
FIG. 3 is a top plan view of an air compressor in accordance with the invention.

Turning now to FIGS. 2–4 there is shown an oilless air compressor 30 in accordance with the invention. As in the prior art example, an electric motor 32 rotates a motor shaft 35 located inside an unvented, sealed crankcase 34. Two pistons 37, 37 having eccentric bearings 38, 38 engage the motor shaft 35, and are reciprocated within opposed cylinders 39, 39. In order to tolerate heat and resist corrosion, the eccentric bearings 38, 38 are preferably constructed of stainless steel rather than forged steel as in conventional eccentrics. Whereas in conventional low blow-by compressors, the pistons may be specially fitted with 3 piston rings, the pistons 37, 37 are standard, and are provided with only 2 piston rings 43, 43 (see FIG. 9). Reed valve assemblies 40, 40 control gas flow in and out of the working chambers of the cylinders 19, 19, and the cylinders are capped by anodized aluminum cylinder heads 41, 41. The cylinders 39, 39 are constructed of bronze, rather than conventional cast iron in order to resist corrosion. The motor shaft 35 terminates within the inner chamber 44 of the crankshaft 34, and the fluid tight inner chamber 44 of the crankcase 34 is sealed by a solid cover plate 46. A seal could be equally effected by constructing the crankcase as two cast half shells. No space occupying cooling fan is provided as in the prior art example shown in FIG. 1, so that the sealed crankcase 34 is completely uncooled. The inventors have found that the cooling fan can be eliminated to save space, because the compressor operates in a refrigerated environment. A base plate 48 is provided for mounting the entire unit in place. The unit is provided with a conventional intake manifold 52 and an exhaust manifold 54.

Blow-by accumulating in the inner chamber 44 of the crankcase 34 during operation of the compressor unit 30 produces an elevated pressure therein. In order to relieve this pressure a T-adaptor 42 is placed in a through-hole 55 bored in the solid cover plate 46, and connected to tubing 47, 47 leading from the T-adaptor 42 to the inlets of the cylinders 39, 39 via elbow adapters 49, 49. This system establishes a fluid return path between the internal chamber 46 of the crankcase 34 and the inlets, so that the blow-by can recirculate. Importantly none of the blow-by is vented into the controlled atmosphere surrounding the compressor unit 30.

As a further measure for containing cylinder gases, an improved seal is provided between the cylinder head 41, and the valve assembly 40. Turning first to FIG. 7, the prior art devices utilize a cylinder head gasket disposed between the cylinder head 21 and the valve assembly 20. In FIG. 8 there is shown a preferred embodiment of a cylinder head sealing arrangement in accordance with the invention, wherein an o-ring 45, constructed of high-temperature plastic, is seated in an annular groove 51 formed in the valve assembly 40 and compressed between the cylinder head 41 and the valve assembly 40 when the unit is assembled. A second annular groove 57 is formed on the opposite side of the valve assembly 40 for seating a second o-ring 56. Of course the grooves 51, 57 could alternatively be formed in the cylinder head 41 and the cylinder 39 respectively. In either case excellent fluid tight seals result that are capable of withstanding harsh operating conditions and have long lives. These seals are superior to the notoriously unreliable gaskets of the prior art devices.

The use of the compressor unit 30 in its operating environment is explained with first with reference to FIG. 6. A cargo container 600 for perishables, such as fruit, is indicated by the dashed line. The atmosphere within the container is nitrogen enriched and oxygen depleted. Ideally the atmosphere in the container 600 has less than 5% oxygen Refrigeration equipment, a power source, and control equipment (not shown) are mounted in a rack that attaches to the exterior of the container. An air compressor 630 in accordance with the preferred embodiment of the invention described above is disposed inside the container. Ambient air is brought from outside the cargo container 600 to an inlet of the compressor 630 by a tube 602. Compressed air is conducted from an exhaust of the compressor 630 through tube 604 to a gas separator 640, in which selective semi-permeable membranes separate rapidly diffusing gases, mainly $O_2$ and $CO_2$ from more slowly diffusing gases, principally $N_2$. Such separators are well known to the art. The $N_2$ enriched effluent of the gas separator is continually vented into interior of the cargo container 600 where desired $O_2$ levels are eventually achieved and maintained. While the gas separator 640 is shown inside the cargo container 600, it could be disposed externally.

Figure 5:
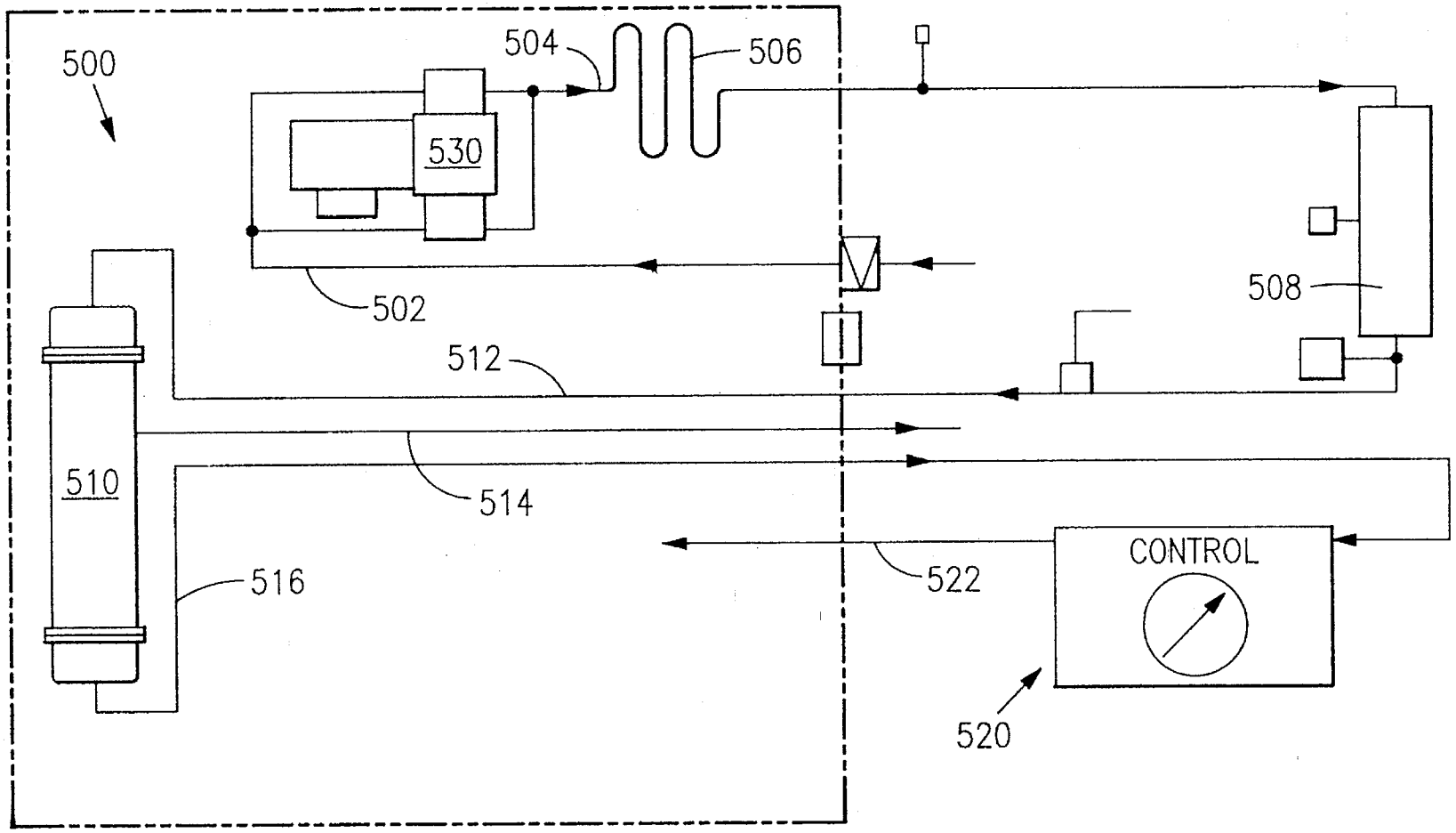
FIG. 5 is a schematic diagram of a system including a compressor in accordance with the invention operating to maintain a controlled atmosphere.

Turning now to FIG. 5, a system for using an air compressor is shown in greater detail. The interior of a cargo container is shown generally by reference numeral 500, enclosed by a double-dashed line. An air compressor 530, constructed in accordance with the preferred embodiment described above is mounted inside the cargo container 500. Ambient air is brought into the intakes of the compressor via line 502. Hot compressed air, typically at 50–115 psi, is exhausted through line 504, and then processed through a condenser 506, and then valved through a suitable filter 508 for removal of particulates. It is often possible to mount some of the components, such as the filter 508, within the existing structure, so as not to impact the payload capacity of the container. Filtered air is conducted via line 512 through a gas separator 510, whose operation has already been described with reference to FIG. 6. The oxygen-rich fraction of the effluent is vented to the outside of the cargo container 500 via line 514. The oxygen poor, nitrogen rich fraction is discharged from the gas separator 510 through line 516 to an analyzer and control means 520. The oxygen poor fraction then enters the interior of the container 500 through line 522.

While this invention has been explained with reference to the structure disclosed herein, it is not confined to the details set forth and this application is intended to cover any modifications and changes as may come within the scope of the following claims:

What is claimed is:

1. An oilless fluid compressor, comprising:

an oilless cylinder;

a valve assembly disposed in said cylinder, said valve assembly comprising a valve retainer fabricated of a temperature resistant material selected from the group consisting of stainless steel and a high temperature plastic;

a piston disposed within said cylinder;

a fluid-tight crankcase that is isolated from an atmosphere thereabout;

a rotating motor shaft disposed in said crankcase;

an eccentric bearing, mounted on an extension of said piston, said bearing being disposed on said rotating motor shaft for reciprocation of said piston in said cylinder;

an inlet in fluid communication with said cylinder;

a fluid connection between said crankcase and said inlet, whereby fluid blowing by said piston during a compression stroke thereof is returned from said crankcase through said fluid connection to said inlet for recycling.

2. An oilless fluid compressor, comprising:

two opposed oilless bronze cylinders, each having an air inlet, a body, and a cylinder head;

a valve assembly disposed in each said cylinder, said valve assembly comprising a valve retainer fabricated of a temperature resistant material selected from the group consisting of stainless steel and a high temperature plastic;

first o-rings disposed between said cylinder head and said valve assembly in each said cylinder;

second o-rings disposed between said valve assembly and a body of each said cylinder;

a piston disposed within each said cylinder, each said piston having no more than two piston rings;

an uncooled fluid-tight crankcase that is isolated from an atmosphere thereabout;

a rotating motor shaft disposed in said crankcase;

an eccentric bearing, mounted on an extension of each said piston, said bearings being disposed on said rotating motor shaft for reciprocation of said pistons in said cylinders;

a pipe extending between said a hole bored in said crankcase and said air inlets for establishing fluid communication between said crankcase and said air inlets;

whereby fluid blowing by said pistons during a stroke thereof is returned from said crankcase via said pipe to said inlets for recycling.

3. The compressor according to claim 2, wherein said first o-rings and said second o-rings are constructed of high temperature plastic.

* * * * *